United States Patent [19]

Klaeger

[11] 3,933,175

[45] Jan. 20, 1976

[54] SNIFTER VALVE USEFUL IN CONTROL MEANS FOR A PISTON IN A CYLINDER

[76] Inventor: Joseph H. Klaeger, 610 Chauncey, Apt. No. 2, San Antonio, Tex. 78216

[22] Filed: Dec. 5, 1973

[21] Appl. No.: 421,844

[52] U.S. Cl. ..... 137/595

[51] Int. Cl.[2] ..... F16K 31/12

[58] Field of Search ..... 137/495, 595; 251/48, 51

[56] References Cited

UNITED STATES PATENTS

| | | | |
|---|---|---|---|
| 2,119,084 | 5/1938 | McQuiston | 137/595 |
| 2,724,407 | 11/1955 | Robinson | 137/595 |
| 3,042,061 | 7/1962 | Dobrikin | 137/495 |

*Primary Examiner*—Irwin C. Cohen
*Assistant Examiner*—George L. Walton
*Attorney, Agent, or Firm*—Willard J. Hodges, Jr.

[57] ABSTRACT

The device of this invention was developed for utilization in a pneumatic oil well pump actuator. The snifter valve performs a bleeder valve function in the control mechanism of a piston in a cylinder. The controls to which this invention is particularly suited comprise a shifting floating piston bleeder valve in conjunction with the improved snifter valve to replace a conventional button bleeder valve, in addition the device incorporates braking components in the snifter valve constructed to arrest and cushion the piston at each end of a cyclic stroke.

6 Claims, 11 Drawing Figures

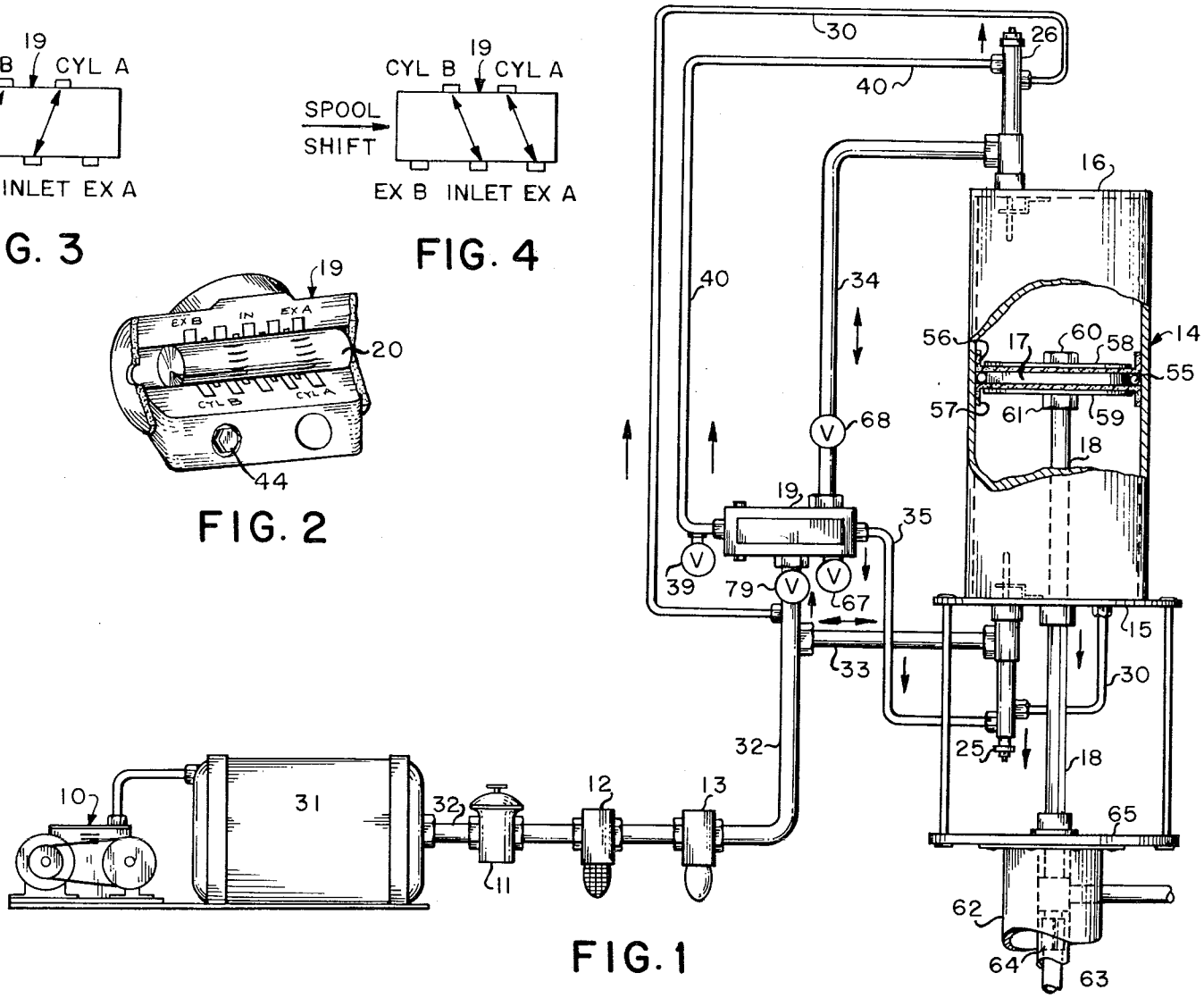
FIG. 1
FIG. 2
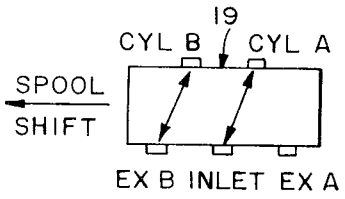
FIG. 3
FIG. 4

SNIFTER VALVE USEFUL IN CONTROL MEANS FOR A PISTON IN A CYLINDER

CROSS REFERENCE TO RELATED APPLICATION

This invention is related to my U.S. Pat. No. 3,643,432 and to my co-pending application Ser. No. 209,788 filed December 20, 1971, now U.S. Pat. No. 3,782,249 entitled "Pneumatic Counter Balanced Oil Well Pump Actuator Utilizing an Improved Snifter Valve" and is a continuation in part of said application.

BACKGROUND OF THE INVENTION

Steam, air, gas and hydraulic actuators are numerous and varied in construction. The art of pumps and pumping is highly developed. Your inventor, having devoted many years to problems of pumping and oil well servicing, developed my prior invention desiring to improve production in gaseous wells and in secondary recovery where heat is used to release crude oil in oil sands or porous rock strata. A desire to economize in the quantity of gas or air used to power actuator prompted the making of subject invention.

SUMMARY OF THE INVENTION

This invention is adapted to the utilization of any fluid under pressure as a motive force. The preferred embodiment is particularly designed to use natural gas under pressure or air supplied by a compressor as the motive force. The context in which the invention may be employed utilizes a pumping cylinder in which is movably mounted a piston secured to a piston rod. The cylinder is connected to a power tank that may be either a reservoir of gas or the tank of a compressor. A single power line communicates with the bottom and top of the pumping cylinder. In a modified embodiment a first tank may be employed to over counter balance the bottom of the pumping cylinder and a second tank utilized to power the top of the pumping cylinder. In each embodiment the flow of the compressed air or gas is selectively controlled by the floating piston of a three-way valve. The movement of the piston is activated by a top and bottom snifter valve with associated bleeder lines. The construction of the snifter valve is new to the art. They are self-cleaning particularly adapted for use in the environment for which designed and incorporate an integral braking structure which eases the pumping piston to a momentary halt as the direction of the drive is reversed. The brake disc with seat and choke vent is an improved design producing desired results and operation.

For a detailed description of the construction of the operation of a preferred embodiment and the context in which it is utilized, reference is made to the attached drawings wherein like reference characters are utilized to refer to identical or equivalent components throughout the various views and the following detailed description.

BRIEF DESCRIPTION OF THE DRAWINGS

FIG. 1 is an elevation view partially schematic of a combined composite device in position on a well head.

FIG. 2 is an isometric view partially in section of the three-way valve disclosing the floating piston in the preferred porting arrangement.

FIG. 3 is a schematic illustrating the three-way valve with piston in the left position.

FIG. 4 is a schematic view illustrating three-way valve with a piston in the right position.

DESCRIPTION OF THE PREFERRED EMBODIMENT

Figure 5:
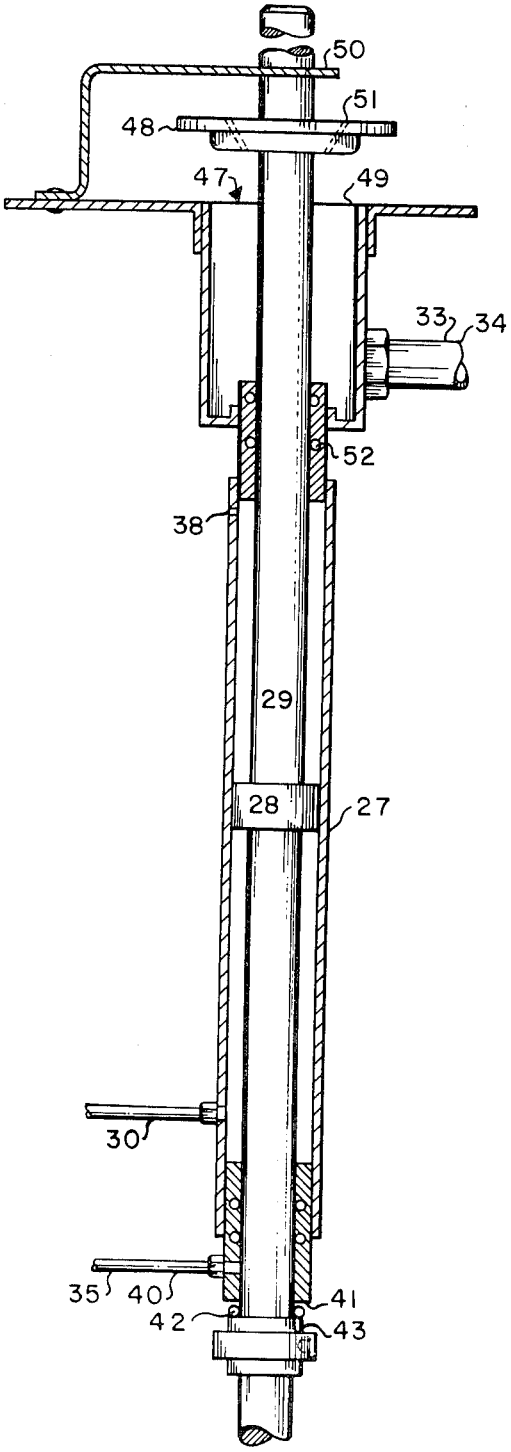
FIG. 5 is a detailed illustration of the construction of the compression loaded piston snifter valve particularly suited for deep wells.
Figure 6:
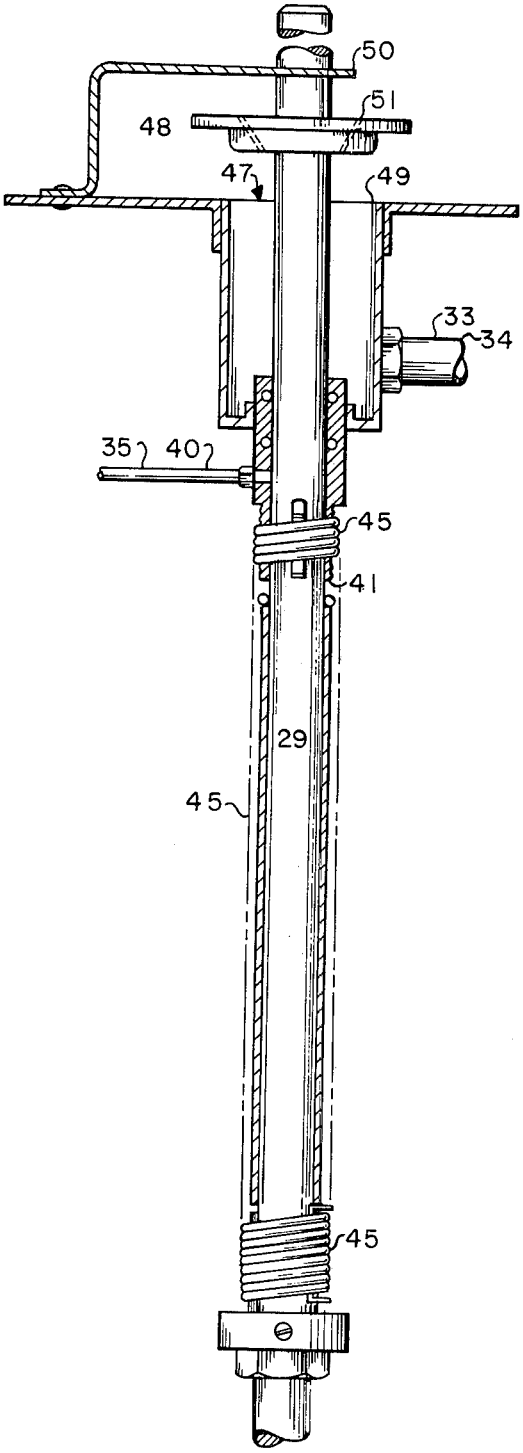
FIG. 6 is a detailed illustration of the construction of the spring loaded snifter valves particularly adapted for shallow wells.

For a detailed description of the construction and utilization of the preferred embodiment, reference is made particularly to FIGS. 1, 5, and 6. The device of this invention may be powered by a compressor means 10 which provides high pressure gas or air through a pressure regulator 11, filter 12 and oiler 13 to the pumping cylinder 14. Appropriate porting and controls are mounted in the pumping cylinder bottom 15 and in the pumping cylinder top 16. Movably mounted in cylinder 14 is pumping piston 17 which is secured to piston rod 18. Pumping piston 17 is sealed to the pumping cylinder 14 wall by suitable means such as piston O rings 55 or sealing cups 56 and 57.

The actuation of the pumping piston 17 is regulated by a three-way valve 19 (best illustrated in FIGS. 2, 3, and 4). Floating piston valves of similar configuration are commercially available from various sources. The particular valve used in the preferred embodiment is widely distributed by Womack Machine Company, Dallas, Texas, under the Trade name of AAA Products International. The usual design of these valves 19 include an air passage connecting the inlet to each end of the floating piston 20. Use of the passage is optional; it may be used or blocked by a gasket. Some embodiment of these valves have been patented. One example is U.S. Pat. No. 2,729,242 to Olson. Movement and positioning of floating piston 20, FIG. 2, through suitable porting and venting controls the flow of gas or air from the compressor 10 to the pumping cylinder 14 to accomplish the desired actuation of piston 17. The floating piston 20 will conventionally hold its position in the valve 19 due to pressure on each end until one of the bleeder lines 35 or 40 is vented to the atmosphere releasing pressure on one end of the piston 20 causing piston 20 to shift. The bottom snifter valve 25 and a top snifter valve 26 is mounted in their corresponding portions of pumping cylinder 14 for the purpose of venting the bleeder lines 35 and 40, respectively, to the atmosphere for shifting the piston 20. For an illustration of the construction of the compression loaded snifter valves 25 and 26, reference is made to FIGS. 5 and 7. This embodiment of the snifter valve is constructed with a snifter cylinder 27 in which is positioned a floating snifter piston 28 mounted on a snifter rod 29. In construction of the snifter valves 25 and 26, it is desirable to drill a small weep hole 38 in the upper extremity of cylinder 27 to insure that trapped gas or air does not lock piston 28 in the open position. The species of the snifter valve illustrated in FIGS. 5 and 7 are particularly suited for utilization in the embodiment of the preferred device utilized in conjunction with pumping deep wells.

A context in which the invention is particularly useful is illustrated in FIG. 1. The piston 17 receives its power or activating force from a power tank 31 which may comprise a natural gas reserve tank or be utilized in conjunction with a compressor 10. Power line 32 leading through regulator 11, filter 12 and oiler 13 communicates with a bottom power line 33 communicating through bottom snifter valve 25 secured in the pumping cylinder bottom 15. Comparably, the top power line 34 communicates with the pumping cylinder top 16 through top snifter valve 26. Three-way valve 19 is connected to the bottom and top snifter valves 25 and 26 respectively by bottom bleeder line 35 and top bleeder line 40. The snifter valves 25 and 26 are each constructed with bleeder vents 41 which are sealed by the combined action of O ring 42 and O ring seats 43. The configuration of the snifter valves 25 and 26 in the pumping cylinder bottom and top 15 and 16 are identical in construction. In the species of the snifter valve which is compression loaded (illustrated in FIG. 5) bleeder vent 41 is closed and sealed by the O ring 42 and the O ring seat 43 which is, in this species of the device, held normally in a closed position by the compression pressure supplied from pumping cylinder bottom 15 through snifter pressure line 30 against snifter piston 28 moving snifter rod 29 to the closed position. When the rod 29 is shifted by the piston 17, the bleeder vent 41 is opened venting the bleeder lines 35 or 40 to atmosphere thereby shifting the piston 20 in the valve 19. It is preferable to construct in top bleeder line 40 a manually operated overriding vent valve 39. An opening of the vent valve 39 vents bleeder line 40 to the atmosphere, shifting the floating piston 20 to the left, resulting in the power piston 17 being forced to the bottom 15 of pumping cylinder 14. This overriding action is beneficial in the clearing of sand from the ball valve seat of the bottom hole pump (not shown). In the species of the device illustrated in FIG. 6 which is particularly adapted for shallow wells, snifter rod 29 is retained in the closed position by a snifter tension spring 45 retaining bleeder vent 41 closed by spring pressure. An important feature of the device of this invention is the brake 47 combination illustrated in each species of the device of FIGS. 5, 6 and 7 and is utilized in both the bottom 15 portion of the pumping cylinder and the top 16 portion of the pumping cylinder. This braking device 47 comprises a brake disc 48 which may incorporate a friction device such as an O ring or teflon disc contacting the snifter rod 29, the disc 48 is frictionally slidably mounted on snifter rod 29 and is retained adjacent disc seat 49 and constitutes a portion of both the bottom 25 and top 26 snifter valve. The brake disc 48 is retained within desired limits by brake yoke 50 which is an L shaped member welded to and projecting outward from the top 16 or bottom 15 of the pumping cylinder 14. In the design and utilization of the preferred embodiment, it was found desirable to drill two (2) 1/16 inch holes through each of the brake discs 48. These holes function as choke vents 51 and assist in the equalization of the pressure on each side of brake disc 48 to insure its movement as desired responsive to the travel of snifter rod 29. Snifter rod 29 should be sealed against the walls of snifter cylinder 27 by suitable packing means. In the preferred embodiment, snifter rod O ring seals 52 were utilized and functioned satisfactorily. Thus, when the piston 17 in the cylinder 14 reaches the end of travel, the piston 17 will contact and move rod 29 which, in addition to opening vent 41, will carry the brake 51 into position on the seat 49 closing off the escape of gas from the cylinder 14 (except through chokes 51) and the trapped gas in the cylinder 14 will cushion and stop the piston 17.

Figure 7:
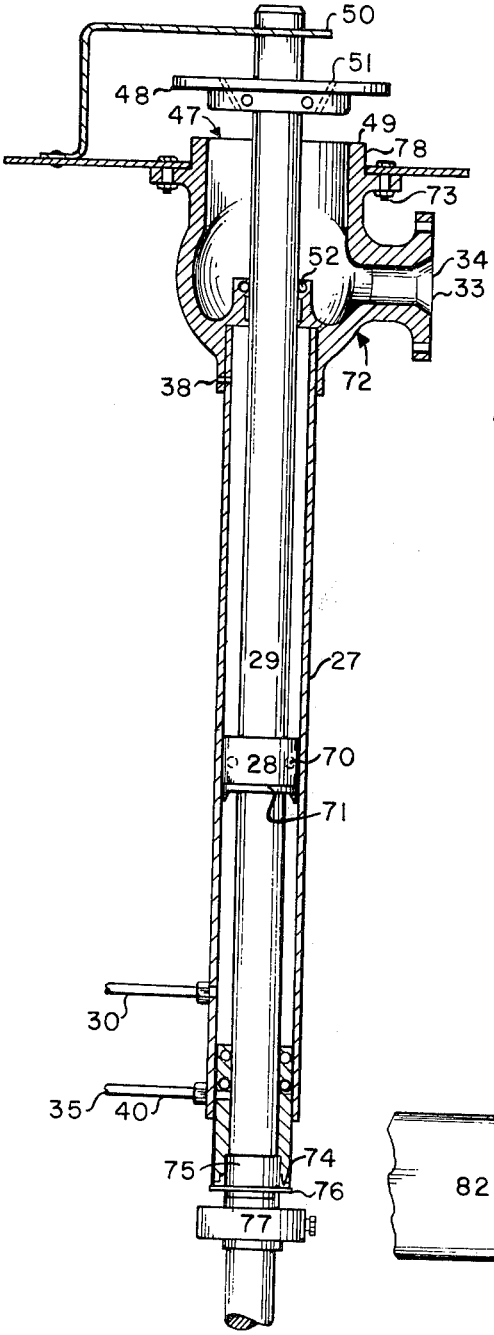
FIG. 7 illustrates another model of the snifter valve utilizing an improved bleeder vent and sealing means.

The construction on the improved snifter valve of FIG. 7 varies from the species illustrated in FIG. 5 in that snifter piston 28 incorporates an internal O ring 70 and a sealing cup 71. The base 72 of the snifter valve is a casting secured to the pumping cylinder 14 by means of a snifter valve mount 73 or screws. The bleeder vent 41 comprises a phenolic or neoprene sealing disc 74 in lieu of O ring 42, a sealing probe 75 is also employed to function as seat 43. A rubber or phenolic shock absorbing washer 76 is juxtapositioned between the retaining collar 77 and cylinder 27 to prevent metal to metal contact. The snifter valve base 72 is constructed with a brake seat 78 which projects into the power cylinder 14. Although not specifically illustrated, the improved sealing disc 74 and sealing probe 75 as well as the shock absorbing washer 76 may be incorporated in the spring loaded species of the invention illustrated in FIG. 6.

In construction the pumping cylinder 14 lengths and diameters might well be varied as conditions dictate. A typical preferred embodiment utilized a ten foot stroke. The cylinder was constructed of cold drawn steel having an interior diameter of 8 inches. The interior surface of the cylinder should be honed or polished to produce a smooth surface and assist in optimum sealing of pumping piston 17. A groove is preferably constructed in pumping piston 17 into which is mounted a piston O ring 55. The body of the piston 17 may be constructed of half inch steel plate. An upper cup 56 and lower cup 57 are attached adjacent pumping piston 17. An upper plate 58 and a lower plate 59 are constructed of ¼ inch sheet metal which is secured in position by upper retainers 60 and lower retainer 61. Such a structure functioned satisfactorily. The cups 56 and 57 may be constructed from neoprene or fabric impregnated rubber-like substance such as a neo-fab material. Other plastics or rubbers could be utilized; however, they should be resistant to petroleum products and preferably substantially heat resistant. Under certain operating conditions, such as high pressure or high heat conditions, teflon type seals might well be utilized. In a typical pumping situation pump cylinder 14 would be secured to a well head 62 and piston rod 18 attached to sucker rods 63. This attachment would normally be accomplished by sucker rod clamp 64 with the cylinder 14 secured to well head 62 by a well head bracket 65. The construction of the floating piston 20 three-way valve 19 will not be described in detail in that the item is well known and commercially available. A valve 19 utilizing a ¼ inch diameter piston 20 is satisfactory for shallow well pumping. For deep wells, a 1 inch to 1½ inch diameter piston 20 is preferable. A (10) horse power air compressor with a pumping capacity of (60) cubic feet per minute and a (32) cubic foot power tank 31 functions satisfactorily in the preferred embodiment and was found adequate to power adjacent pumping units. Any adequate source of supply of compressed gas or air may, however, be utilized.

For a description of the operation of the combination, reference is particularly made to FIGS. 1–4 and 8. The direction of flow of the gases in the system is schematically suggested by direction of flow arrows on FIGS. 1 and 8. After the device has been secured in position on the well head, and bracket 65 and the sucker rod 63 operably secured, the compressor 10 or power tank 31 is utilized to charge pumping cylinder 14 with a pressure sufficient to lift pumping piston 17 and sucker rod 63 with the associated oil and friction load. In initiating operation pressure regulator 11 is opened gradually a sufficient amount to activate the system. The pressure maintained in power tank 31 should normally be a few pounds per square inch over that required for lifting pumping piston 17 to the top of the pumping cylinder 16. The pumping piston 17 will then contact and activate the top snifter valve 26 opening vent 41 and actuating brake 51. This action will shift the floating piston 20 or spool of the three-way valve 19 to the left which would admit air through the intake port of the three-way valve into the port designated as cylinder A and into line 34 which is the top of pumping piston 17. This admission of pressure to pumping cylinder 14 in conjunction with the weight of the sucker rods 63 causes the pumping piston 17 to move downward forcing the air or gas in the bottom portion of the pumping cylinder 15 out through the bottom power line 33 returning the gas or air to power tank 31. In addition, as the piston 17 moves downwardly, air in line 30 will reset the top snifter valve 26 by acting on the backside of piston 28 to close the top vent 41 and reset the top brake 51. As pumping piston 17 approaches the bottom of pumping cylinder 15, piston 17 strikes snifter rod 29 of the bottom snifter valve 25 opening bottom vent 41 causing the floating piston 20 of the three-way valve 19 to shift to the right interconnecting cylinder A port and exhaust A port venting the air or gas from the top of the pumping cylinder 16 through line 34 through vent valve 67. This venting of air from the top of the pumping cylinder 16 permits the counter balance or pressure load in power tank 31 by action through bottom power line 33 to lift pumping piston 17 again to the pumping cylinder top 16. The piston 17 will again strike top snifter valve 26 repeating the cycle. In the specific configuration of this embodiment of the floating piston three-way bleeder valve 19, only the inlet port, cylinder A and exhaust A are employed. The cylinder B port and exhaust B are closed by plug 44, FIG. 2. To assist in regulating the rate of the pumping cycle, an adjustable vent valve 67 is attached to the exhaust port A of the three-way valve 19. A partial closing of this valve 67 will slow the rate of the up stroke of pumping piston 17. A second regulating valve is positioned in top power line 34 which is designated as cyclic rate valve 68 which can be closed or opened to vary the rate of pumping piston 17 down stroke. As an alternative method of construction, a regulator valve 79 may be positioned in the power line 32 adjacent the three-way valve 19 in addition to or in lieu of the cyclic rate valve 68 in the top power line 34. Cyclic rate valve 68 and regulator valve 79 may each be utilized with varying results in adjusting the cyclic rate of the pumping piston 17.

It has been discovered in a test conducted with the preferred embodiment in the field use as well as on a test stand model that when utilizing the pumping pressure of 40 psi in power tank 31, 10 to 15 psi admitted to the pumping cylinder top 16 is adequate to move the pumping piston 17 to the bottom of its cyclic stroke in view of the static load placed on piston rod 18. This results in venting through vent valve 67 of a volume of gas or air equivalent to the volume of pumping cylinder 14 at approximately 10 psi rather than venting an equivalent volume at 40 psi in a direct drive cycle utilizing a direct exhausting of the propelling gases from the pumping cylinder 14. A major portion of the gas or air utilized by the system is returned to power tank 31 in the system visualized in this invention because of the direct connection of power line 32 and bottom power line 33, the high pressure gas in the pumping cylinder bottom 15 is returned to power tank 31.

An obvious modification of the preferred embodiment described in detail would be to utilize a separate power tank 31 and power line 32 to over counter balance the pumping cylinder bottom 15 and a second power tank 31 through a control means to intermittently power the pumping cylinder top 16 through the top power line 34. Such an embodiment has been constructed and tested by your inventor. The combination system utilizing a single power tank 31 to over counter balance the pumping cylinder bottom and power the pumping cylinder top 16 is the preferred construction and method of operation.

Figure 8:
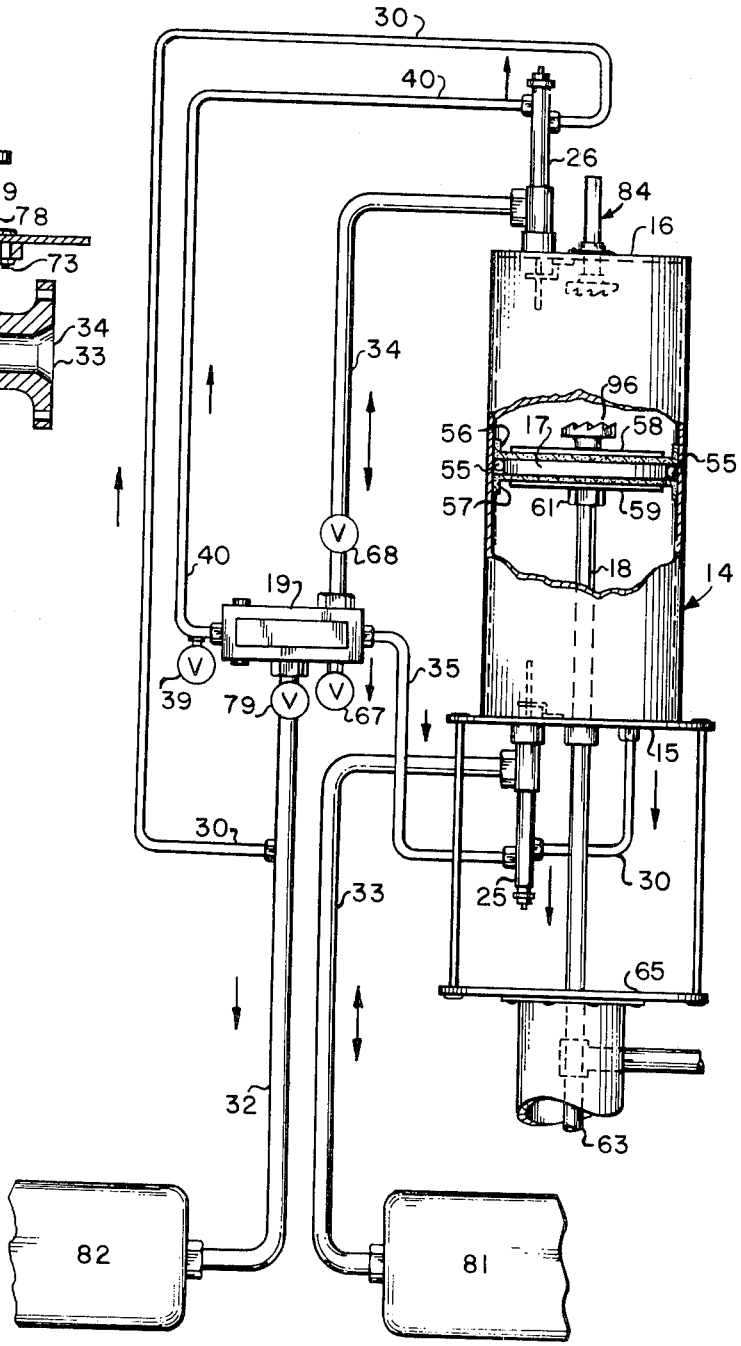
FIG. 8 is a schematic illustration of the actuator system employing an isolated pumping tank and an over counter balance tank.

For an illustration of the construction of this modified embodiment, reference is made to FIG. 8 which illustrates the over counter balance tank 81 directly connected to the pumping cylinder bottom 15 through bottom snifter valve 25. The function of this tank 81 is to at all times apply a lift more than sufficient to counter balance the weight of the sucker rods 63 and the fluid load. The actuation of the pumping piston 17 is accomplished by a separate pumping tank 82 which is controlled through a three-way valve 19 in conjunction with the snifter valves 25 and 26 as previously described.

In the utilization of a pumping system in deep oil wells with high paraffin content rotation of sucker rods 63 is desirable. As an adjunct or modification of the system of this invention, a rod rotator 84 was developed. For a description of the construction and operation of the preferred embodiment of this modification, reference is made to FIGS. 8, 9, 10 and 11. The sucker rod rotator 84 is constructed integral with or secured to the power cylinder top 16. The body of the device comprises a hollow cylindrical shaft 85 into which is mounted rotating rod 86. The top section 87 of the rod 86 has machined in its surface on opposite sides two (2) identical rotating grooves 88 extending for approximately ½ the length of the rotating rod 86 and progressively proceeding around the rod for approximately 180° of the surface. These grooves 88 convert at approximately the center point 89 to a straight groove 90 in the bottom section 91 of the rod 86. The bottom section of the rod rotator 84 is secured to the power cylinder top 16 by an air tight shaft bracket 92 which may be secured to the power cylinder top 16 by bracket 92. Threadably mounted on the bottom section 91 of rotating rod 86 is the top half 94 of dog clutch 95. The bottom half 96 of the dog clutch 95 may be threadably secured to the piston rod 18 in lieu of the upper retainer 60. The contacting surface of the top half 94 and the bottom half 96 of the dog clutch 95 have constructed in their mating surfaces interlocking teeth 97. When the two surfaces contact, the teeth 97 mesh and interlock the top half 94 and the bottom half 96 of the dog clutch 95 together at the top portion of the pumping stroke as piston 17 moves upward. The surfaces release immediately following the initiation of the down stroke. Projecting through opposite sides of the cylindrical shaft 85 into the rotating grooves 88 of the rotating rod 86 are oppositely disposes rotating studs 98.

Figure 9:
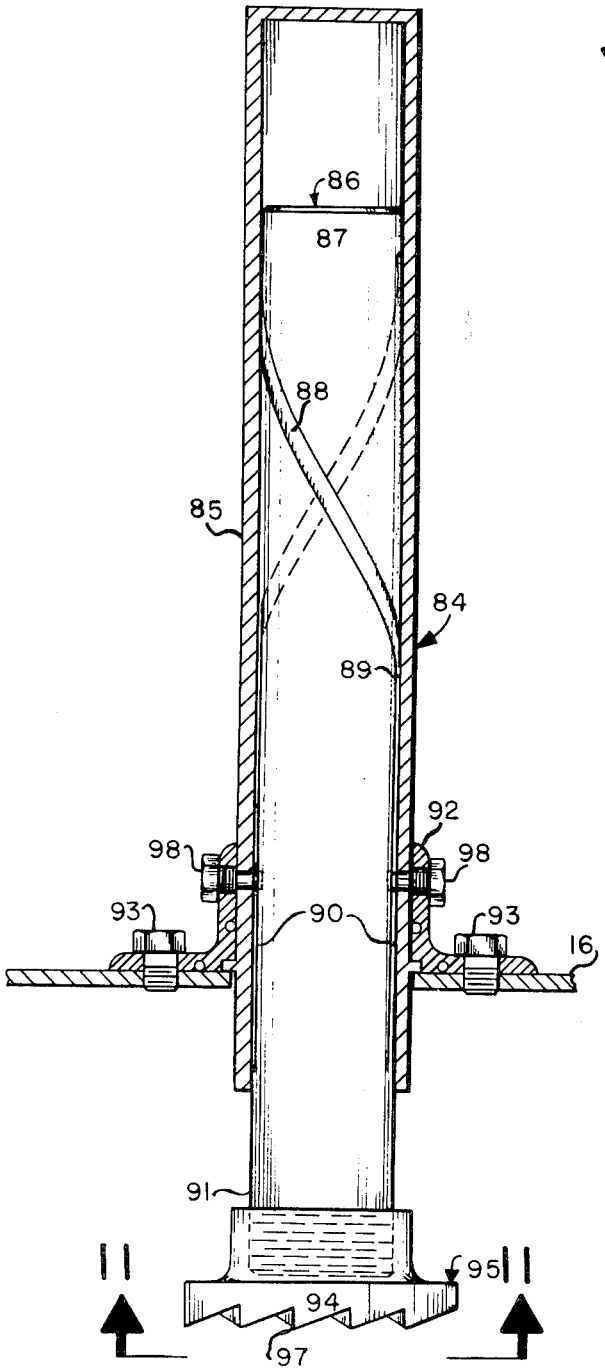
FIG. 9 is an elevation sectional view of the rod rotator partially in section illustrating partially the cylinder top fragmented.
Figure 10:
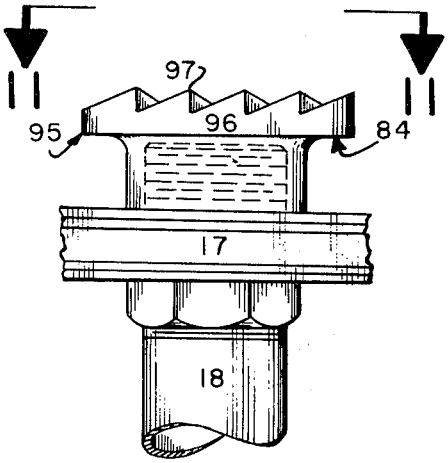
FIG. 10 is an elevation view partially sectionalized and fragmented of that portion of the rod rotator secured to the top of the piston and the piston rod.
Figure 11:
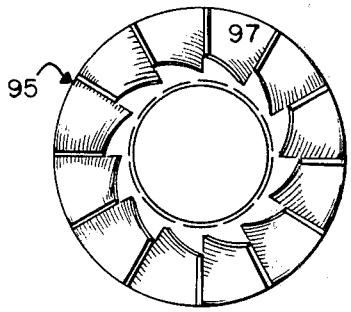
FIG. 11 is a plan view of the face of the intermeshing surfaces of the dog clutch taken substantially on line 11—11 of FIGS. 9 and 10 looking in the direction of the arrows.

For an explanation and operation of the sucker rod rotator 84, reference is made to FIGS. 8 and 9. As pumping pistons 17 approach the pumping cylinder top 16, the rotating rod 86 would be in the lower position extending into cylinder 14. As the piston 17 moves up, dog clutch 95 engages and further upward travel of the piston 17 in the coordinative action of rotating groove 88 and the rotating studs 98 will rotate piston 17 to the center point 89 of rotating rod 86. In the travel of rod 86 through the final half of its movement, the studs 98 will ride in the straight grooves 90; therefore, no rotation occurs. The purpose of this no movement is to avert rotation of piston 17 while it is in contact with snifter rod 29. This modification to the overall combination is adaptable for utilization with my U.S. Pat. No. 3,643,432, and to my invention disclosed in co-pending application, Ser. No. 209,788 filed Dec. 20, 1971.

Having described in detail the construction and operation of the components of this improved pneumatic counter balanced oil well pump actuator, and having described the construction and operation of the preferred embodiment in detail and having summarized above a dual system modification functioning in an equivalent manner, and having described in detail alternative construction of snifter valves 25 and 26, what is desired to be claimed is all modifications of the device not departing from the equivalents of the concepts herein disclosed as defined in the appended claims.

I claim:

1. In the controlled means for pneumatic actuated piston in a pumping cylinder the sub-combination of a snifter valve comprising:

a. an elongated cylindrical snifter cylinder projecting on an axis from a first end to the second end, b. a snifter rod mounted for longitudinal reciprocal movement on the axis of said snifter cylinder, c. a bleeder vent constructed in a first end of said snifter valve, said bleeder vent adapted to move alternately from an open to a closed position responsive to the movement of said snifter rod along the axis of said cylinder, d. pneumatic pressure closing means applied internally of said snifter cylinder for normally urging said snifter rod into a position urging said bleeder vent into contact with closing means secured to said first end of said snifter cylinder, e. a brake disc having a pumping cylinder side and a brake seat side, said brake disc slidably mounted externally of said second end of said snifter cylinder on said snifter rod, said brake disc constructed and arranged to move from an open position not in contact with said snifter cylinder to a braking position in contact with, f. a brake seat secured to said second end of said snifter cylinder adapted to be contacted by said brake disc thereby stopping the flow of gas from said pumping cylinder responsive to the movement of said brake disc to a braking position.

2. The invention of claim 1 including a choke vent penetrating said brake disc from said pumping cylinder side to said brake seat side thereby facilitating passage of gas or air equalizing pressure on the surface of said choke vent thereby preventing variations in the pressure from locking said brake disc into contact with said brake seat preventing movement of said brake disc from the braking position to an open position responsive to reciprocation of said snifter rod.

3. The invention of claim 1 wherein said closing means is a spring.

4. The invention of claim 1 wherein said bleeder vent comprises:

a. a seal encircling said snifter rod adjacent said first end of said snifter cylinder, and b. a seat adapted to encircle said seal and be pressed against said seal thereby sealing said vent.

5. The invention of claim 1 wherein said bleeder vent comprises:

a. a substantially circular sealing disc including an opening encircling said snifter rods, said disc mounted in an opening in said snifter valve cylinder, and b. an elongated probe secured to said snifter rod adapted to penetrating the opening in said circular sealing disc closing said bleeder vent when said probe penetrates said sealing disc.

6. The invention of claim 5 including:

a. a shock absorber washer encircling said snifter rod adjacent said sealing disc, said washer adapted to prevent metal to metal contact between, b. a retaining collar mounted on said snifter rod adjacent said sealing probe when said probe penetrates said sealing disc.

* * * * *